US008074855B2

(12) United States Patent
Johnson

(10) Patent No.: US 8,074,855 B2
(45) Date of Patent: Dec. 13, 2011

(54) BYPASS TYPE FOLLOWER ASSEMBLY HAVING A LATCH MECHANISM ON THE FOLLOWER CLAW

(75) Inventor: Michael P. Johnson, Round Lake, IL (US)

(73) Assignee: Illinois Tool Works Inc., Glenview, IL (US)

( * ) Notice: Subject to any disclaimer, the term of this patent is extended or adjusted under 35 U.S.C. 154(b) by 269 days.

(21) Appl. No.: 12/226,476

(22) PCT Filed: Mar. 26, 2007

(86) PCT No.: PCT/US2007/007411

§ 371 (c)(1),
(2), (4) Date: Sep. 21, 2009

(87) PCT Pub. No.: WO2007/126735

PCT Pub. Date: Nov. 8, 2007

(65) Prior Publication Data

US 2010/0155451 A1 Jun. 24, 2010

(51) Int. Cl.
*B25C 1/04* (2006.01)

(52) U.S. Cl. ..... 227/120; 227/136

(58) Field of Classification Search ..... 227/120, 227/8, 109, 119, 130, 136
See application file for complete search history.

(56) References Cited

U.S. PATENT DOCUMENTS

| | | | | |
|---|---|---|---|---|
| 4,197,974 | A * | 4/1980 | Morton et al. | 227/8 |
| 4,389,012 | A * | 6/1983 | Grikis et al. | 227/120 |
| 5,626,274 | A * | 5/1997 | Shkolnikov et al. | 227/109 |
| 6,149,046 | A * | 11/2000 | Ho et al. | 227/8 |
| 6,199,739 | B1 * | 3/2001 | Mukoyama et al. | 227/8 |
| 6,296,167 | B1 * | 10/2001 | Jen | 227/120 |
| 6,592,014 | B2 * | 7/2003 | Smolinski | 227/8 |

FOREIGN PATENT DOCUMENTS

EP 1231028 8/2002

* cited by examiner

*Primary Examiner* — Scott A. Smith
(74) *Attorney, Agent, or Firm* — Law Offices of Steven W. Weinrieb

(57) ABSTRACT

A follower mechanism of the bypass type comprises a follower body which is normally spring-biased in the forward direction so as to, in turn, normally bias a strip supply of nail-type fasteners in the forward direction toward a discharge path along which the leading one of the nail-type fasteners will he driven and discharged out from the fastener-driving tool. A follower claw is normally spring-biased, around the pivotal axis of a pivot pin mounted upon the follower body, to a position at which the follower claw can engage the trailing one of the nail-type fasteners so as to bias the supply strip of nail-type fasteners in the forward direction. A latch-hook is integrally provided upon the follower claw for engaging an undercut region of the fastener-driving tool magazine end cap in order to retain the entire follower mechanism at a rearwardly retracted position within the magazine assembly of the fastener-driving machine.

20 Claims, 5 Drawing Sheets

BYPASS TYPE FOLLOWER ASSEMBLY HAVING A LATCH MECHANISM ON THE FOLLOWER CLAW

FIELD OF THE INVENTION

The present invention relates generally to fastener-driving tools, and more particularly to a new and improved fastener-driving tool which has a new and improved follower mechanism or assembly of the bypass type wherein the follower mechanism or assembly of the fastener-driving tool comprises a follower body which is normally spring-biased in the forward direction so as to, in turn, normally bias a strip supply of nail-type fasteners in the forward direction toward a discharge path along which the leading one of the nail-type fasteners will be driven and discharged out from the fastener-driving tool, wherein a follower claw is normally spring-biased, around the pivotal axis of a pivot pin mounted upon the follower body, to a position at which the follower claw can engage the trailing one of the nail-type fasteners so as to bias the supply strip of nail-type fasteners in the forward direction, and wherein a latch-hook is integrally provided upon the follower claw for engaging an undercut region of the fastener-driving tool magazine end cap in order to retain the entire follower mechanism or assembly at a rearwardly retracted position so as to facilitate the unloading of the nail-type fasteners, the performance of dry-cycle tool operations, or the resolution of fastener jam conditions.

BACKGROUND OF THE INVENTION

Fastener-driving tools for driving fasteners into substrates are of course well-known in the art. Such fastener driving tools conventionally comprise a magazine for holding a supply of nail-type fasteners, and a spring-biased follower mechanism or assembly for effectively engaging the trailing one of the nail-type fasteners disposed within the fastener magazine in order to normally bias the supply of nail-type fasteners in the forward direction toward a discharge path along which the leading one of the nail-type fasteners will be driven and discharged out from the fastener-driving tool. One type of follower mechanism or assembly that is known in the art is a bypass-type follower mechanism or assembly wherein the follower mechanism or assembly comprises a follower body which is normally spring-biased in the forward direction so as to, in turn, normally bias a supply of nail-type fasteners in the forward direction toward the discharge path along which the leading one of the nail-type fasteners will be driven and discharged out from the fastener-driving tool, and a follower claw which is normally spring-biased, around the pivotal axis of a pivot pin mounted upon the follower body, to a position at which the follower claw can engage the trailing one of the nail-type fasteners such that the follower mechanism or assembly can then bias the supply strip of nail-type fasteners in the forward direction under the influence of the biasing spring normally acting upon the follower body. The follower claw is thus able to be pivotally moved with respect to the plane within which the supply of nail-type fasteners is disposed.

Accordingly, when, for example, the fastener-driving tool has expended or substantially expended its supply of nail-type fasteners and needs to be replenished with a new supply of nail-type fasteners, the new supply of nail-type fasteners is able to be loaded into the rearward portion of the fastener-driving tool magazine while the follower mechanism or assembly is still disposed within the forward portion of the fastener-driving tool magazine. Subsequently, the follower mechanism or assembly is then able to be moved by an operator in the rearward direction, against the biasing force of the follower mechanism or assembly spring, whereby the pivotal mounting of the follower claw, upon the follower body, permits the follower claw to effectively skip or ratchet over the new supply of nail-type fasteners disposed within the fastener-driving tool magazine and thereby bypass the new supply of fasteners disposed within the fastener-driving tool magazine. When the follower mechanism or assembly has been moved sufficiently rearwardly so as to in fact be disposed behind the new supply of nail-type fasteners, the spring, which normally pivotally biases the follower claw toward the position at which the follower claw can engage the trailing one of the nail-type fasteners, now in fact pivotally biases or returns the follower claw to the position at which the follower claw can engage the trailing one of the nail-type fasteners whereupon the follower claw will in fact engage the trailing one of the nail-type fasteners when the entire follower mechanism or assembly is permitted to move slightly forwardly, under the influence of the follower mechanism or assembly spring, when the follower body is released by the operator. An example of such a bypass follower mechanism or assembly is disclosed within U.S. Pat. No. 6,592,014 which issued to Smolinski on Jul. 15, 2003.

Fastener-driving tools of the aforenoted type are also usually provided with, in effect, an internal operational lockout system or mechanism whereby when the follower assembly or mechanism is disposed at substantially the forward-most position within the magazine assembly of the fastener-driving tool, such as, for example, when only several fasteners remain within the magazine assembly of the fastener-driving tool, or alternatively, when the supply of fasteners has in fact been entirely depleted or removed from the magazine assembly, the fastener-driving tool will be prevented from firing and cycling. Sometimes, however, it is necessary to dry-cycle fire the fastener-driving tool, that is, to fire or cycle the fastener-driving tool when the fastener-driving tool does not contain any fasteners. The purpose of such dry-cycle firing of the fastener-driving tool is to ensure that the fastener-driving tool, and its various components, are in fact working properly after, for example, the fastener-driving has been idle for a substantial period of time, or has been subjected, for example, to substantially cold weather or environmental conditions. Under such circumstances, it is necessary for the operator to manually move the follower mechanism or assembly to a rearward position within the magazine assembly of the fastener-driving tool by means of one hand, and to hold the follower mechanism or assembly at such rearward position within the magazine assembly of the fastener-driving tool by the one hand in view of the fact that, otherwise, the spring-biasing mechanism, that normally operates upon or biases the follower mechanism or assembly in the forward direction, will tend to return the follower mechanism or assembly to the forwardmost position within the magazine assembly of the fastener-driving tool.

In this manner, the fastener-driving tool has effectively been "tricked" into believing that a new supply of nail-type fasteners has been installed within the magazine assembly of the fastener-driving tool, whereby the internal lockout mechanism or system of the fastener-driving tool will no longer prevent the operation of the fastener-driving tool even though the magazine assembly is completely devoid of fasteners. The operator may then dry-cycle fire the fastener-driving tool as a result of the manipulation of the fastener-driving tool by means of the other hand. Alternatively, it is sometimes necessary to manually work upon the fastener-driving-tool, in order to clear a fastener-jammed condition within the fastener-driving tool, when only several fasteners remain within the magazine assembly of the fastener-driving tool. Again, under such circumstances, the operator needs to retract the follower mechanism or assembly, within the magazine assembly, by means of one hand so as to dispose the follower mechanism or assembly at a rearward position within the magazine assembly while he attempts to clear the fastener-jammed condition within the fastener-driving tool with the other hand. As may readily be appreciated, this mode of operation is awkward and sometimes difficult to accomplish, thereby leading to increased production downtime, operator fatigue, and the like.

A need therefore exists in the art for a new and improved fastener-driving tool, and a new and improved nail-type follower mechanism or assembly, of the bypass type, incorporated within the fastener-driving tool wherein the follower claw of the follower mechanism or assembly of the fastener-driving tool will in fact be provided with a latching element or component so as to in fact enable the entire follower mechanism or assembly to effectively be retained at a latched position within the rearward section of the fastener-driving tool when, for example, the fastener-driving tool is to undergo a dry-cycle firing operation, or alternatively, when the operator is working upon the fastener-driving tool in order to rectify a fastener-jammed condition within the fastener-driving tool.

SUMMARY OF THE INVENTION

The foregoing and other objectives are achieved in accordance with the teachings and principles of the present invention through the provision of a new and improved fastener-driving tool which has a new and improved follower mechanism or assembly of the bypass type wherein the follower mechanism or assembly of the fastener-driving tool comprises a follower body which is normally spring-biased in the forward direction so as to, in turn, normally bias a strip supply of nail-type fasteners in the forward direction toward a discharge path along which the leading one of the nail-type fasteners will be driven and discharged out from the fastener-driving tool, and wherein a follower claw is normally spring-biased, around the pivotal axis of a pivot pin mounted upon the follower body, to a position at which the follower claw can engage the trailing one of the nail-type fasteners so as to bias the supply strip of nail-type fasteners in the forward direction. A latch-hook is integrally provided upon the follower claw for engaging an undercut region of the fastener-driving tool magazine assembly end cap in order to retain the entire follower mechanism or assembly at a rearwardly retracted position within, or with respect to, the magazine assembly of the fastener-driving machine. In this manner, both of the operator's hands are free so as to facilitate the performance of dry-cycle tool firing operations, or the removal of jammed fasteners from the fastener-driving tool magazine.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
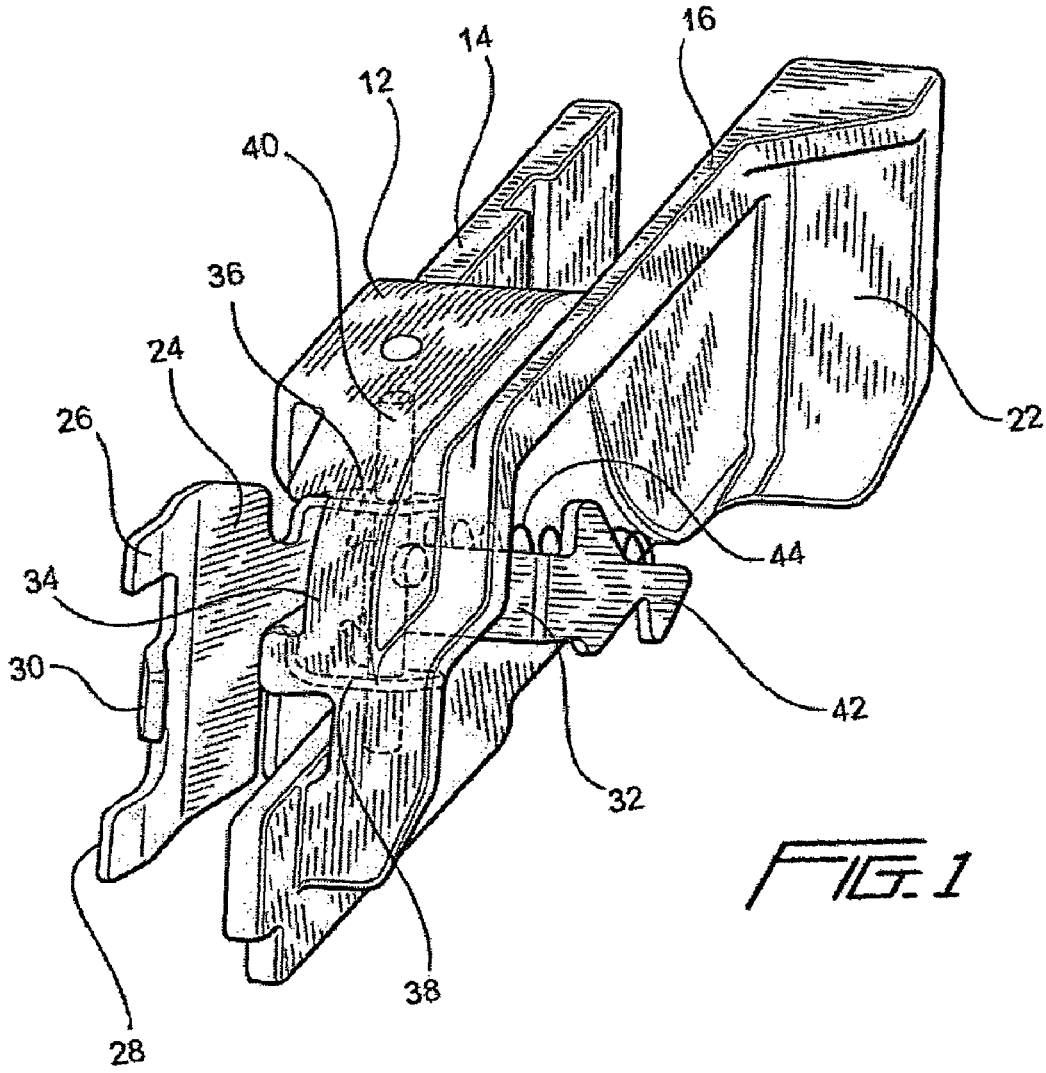
FIG. 1 is a schematic, perspective view of a new and improved follower mechanism or assembly, as constructed in accordance with the principles and teachings of the present invention, and showing, in particular, the follower body, the spring-biased follower claw pivotally mounted upon the follower body, and the follower claw latch-hook formed upon the follower claw for engaging the undercut or recessed portion of the fastener-driving tool magazine end cap so as to retain the follower mechanism or assembly in a latched state at its rearwardmost position with respect to the fastener-driving tool magazine assembly.
Figure 2:
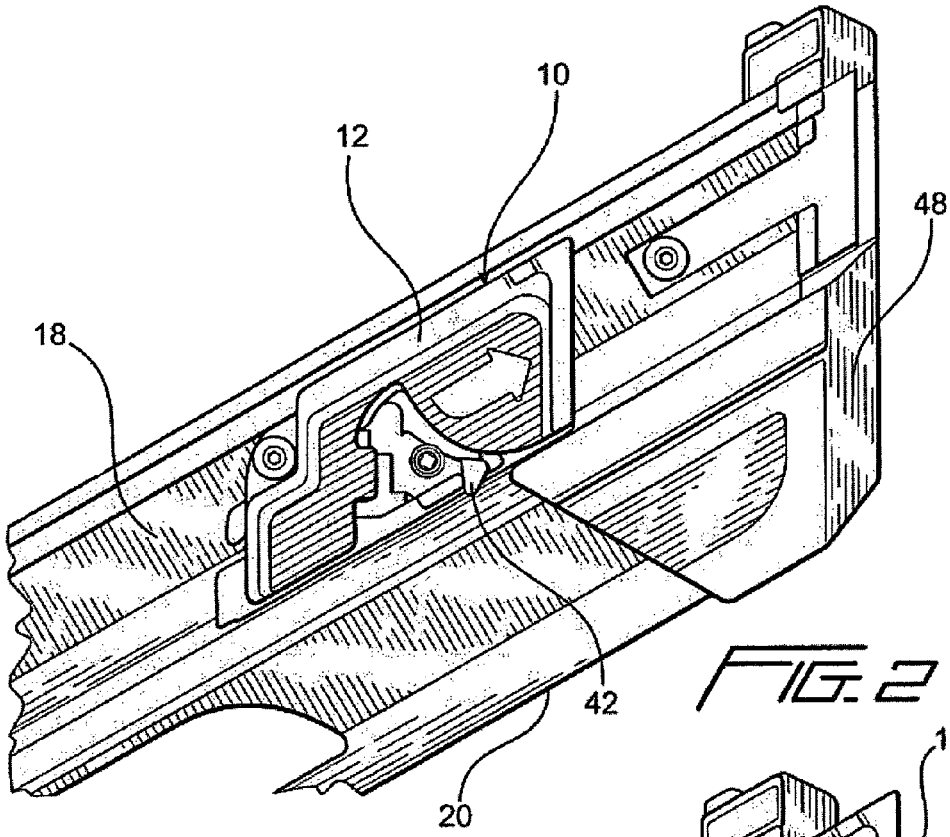
FIG. 2 is a schematic, side elevational view of the fastener-driving tool magazine assembly illustrating the follower mechanism or assembly disposed at a location intermediate its rearwardmost and forwardmost positions within and with respect to the fastener-driving tool magazine assembly.

Referring now to the drawings, and more particularly to FIGS. 1 and 2 thereof, a new and improved nail-type fastener follower mechanism or assembly, as constructed in accordance with the principles and teachings of the present invention, is disclosed and is generally indicated by the reference character 10. More particularly, it is seen that the new and improved nail-type fastener follower mechanism or assembly 10 is seen to comprise a fastener follower body section 12 upon which a pair of oppositely disposed side walls 14, 16 are integrally formed so as to be slidably mounted within suitable track structures defined, within the magazine section 18 of the fastener-driving tool 20. The magazine section 18 of the fastener-driving tool 20 is adapted to contain or house a supply of, for example, nail-type fasteners, and a manually manipulable handle member 22 is integrally formed upon the rear end portion of the side wall 16 of the fastener follower mechanism or assembly 10 so as to project outwardly therefrom and thereby effectively serve as a means by which an operator can, for example, effectively grasp the fastener follower mechanism or assembly 10 and thereby move the same rearwardly within and with respect to the magazine section 18 of the fastener-driving tool 20 after, for example, a new supply of nail-type fasteners has been inserted into the magazine section 18 of the fastener-driving tool 20, so as to permit the fastener follower mechanism or assembly 10 to be disposed behind and engage the new supply of nail-type fasteners disposed within the magazine section 18 of the fastener-driving tool 20. The fastener-follower mechanism or assembly 10 is normally spring-biased in the forward direction, and in this manner, as a result of the engagement of the fastener-follower mechanism or assembly 10 with, for example, the trailing one of the nail-type fasteners disposed within the magazine section 18 of the fastener-driving tool 20, the fastener follower mechanism or assembly 10 will be able to bias the supply of nail-type fasteners in the forward direction in preparation for the serial firing and discharge of the nail-type fasteners out from the fastener-driving tool 20.

Continuing further, and with reference again being made specifically to FIG. 1, it is seen that the fastener-follower mechanism or assembly 10 further comprises a fastener follower claw member 24 which has a substantially planar structure and which is disposed externally of the side wall 14 of the fastener-follower mechanism or assembly 10 so as to be capable of engaging the supply of nail-type fasteners disposed within the magazine section 18 of the nail-type fastener-driving tool 20, and in particular, it is seen that in order to in fact engage the supply of nail-type fasteners disposed within the magazine section 18 of the nail-type fastener-driving tool 20, the fastener-follower claw member 24 is seen to comprise a pair of upper and lower fingers 26, 28, and a centrally located finger 30. The upper and lower fingers 26, 28 extend or project away from the plane of the fastener-follower claw member 24 in a first outwardly divergent direction, while the centrally located finger 30 extends or projects away from the plane of the fastener-follower claw member 24 in a second inwardly divergent direction whereby it can be appreciated and envisioned that the centrally located finger 30, along with the pair of upper and lower fingers 26, 28, effectively defines a substantially V-shaped channel within which the trailing end portion of the supply of nail-type fasteners can effectively be disposed and grasped by means of the fastener-follower claw member 24 so as to be capable of being guided in the forward direction under the influence of the spring-biasing force impressed upon the fastener-follower mechanism or assembly 10.

Still yet further, it is noted that the fastener-follower mechanism or assembly 10 is of the bypass type, that is, when, for example, the fastener-driving tool 20 has expended or substantially expended its supply of nail-type fasteners and needs to be replenished with a new supply of nail-type fasteners, the new supply of nail-type fasteners is able to be loaded into the rearward portion of the fastener-driving tool magazine section 18 while the fastener-follower assembly or mechanism 10 is still disposed within the forward portion of the fastener-driving tool magazine section 18. Subsequently, the follower mechanism or assembly 10 is moved by an operator in the rearward direction, against the biasing force of the follower mechanism or assembly spring, whereby the fastener-follower claw member 24 is able to effectively skip or ratchet over the new supply of nail-type fasteners disposed within the fastener-driving tool magazine section 18 and thereby bypass the new supply of fasteners disposed within the fastener-driving tool magazine section 18. More particularly, it is seen that a cross-piece 32, which extends in a transversely oriented manner within the fastener follower body section 12 and projects outwardly through the oppositely disposed side walls 14, 16 of the fastener-follower mechanism or assembly 10, has a first end portion thereof integrally connected to the fastener-follower claw member 24, and that a substantially U-shaped or C-shaped clevis member 34 is also integrally attached to the transversely oriented cross-piece 32 at an intermediate or central portion thereof.

Figure 4:
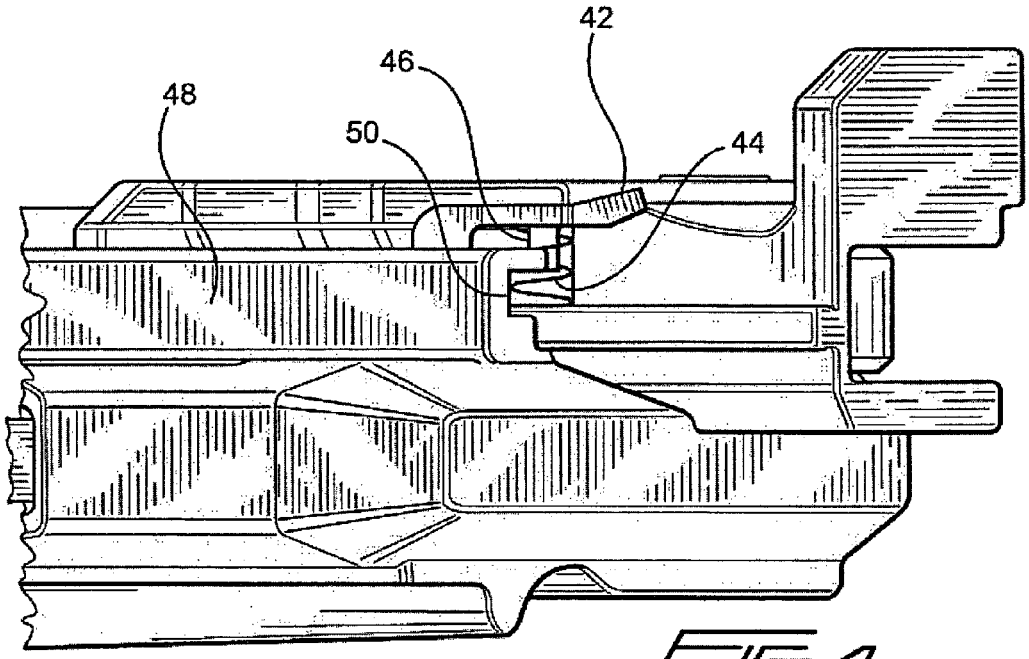
FIG. 4 is a schematic, bottom plan view corresponding to that of FIG. 3 and therefore similarly illustrating the follower mechanism or assembly disposed at its rearwardmost position within and with respect to the fastener-driving tool magazine assembly in preparation for the latching of the same by means of the follower claw latch-hook which is adapted to engage the undercut or recessed portion of the fastener-driving tool magazine end cap.

The substantially U-shaped or C-shaped clevis member 34 comprises substantially vertically spaced upper and lower arm members 36, 38 which are adapted to be pivotally mounted upon a fastener-follower claw pivot pin 40 which is, in turn, fixedly mounted within the fastener follower body section 12. In accordance with the principles and teachings of the present invention, the second opposite end portion Of the transversely oriented cross-piece 32 has a fastener follower claw latch-hook member 42 integrally formed thereon, wherein it is seen that the fastener follower claw latch-hook member 42 is disposed within a plane which is disposed substantially parallel to the plane within which the substantially planar fastener-follower claw member 24 is disposed. A coil spring 44 is adapted to be interposed between an inner surface portion of the fastener follower claw latch-hook member 42 and an inner surface portion of the fastener follower body section 12, or the side wall 14 thereof, and as can best be seen in FIG. 4, a first stub shaft 46 is provided upon an inner surface portion of the fastener-follower claw latch-hook member 42 so as to effectively serve as a seat for a first end portion of the coil spring 44 which projects outwardly through the fastener follower body section 12, or the side wall 16 thereof, while a similarly structured, oppositely disposed, second stub shaft, not shown, is provided upon an inner surface portion of the fastener follower body section 12, or the side wall 14 thereof, so as to likewise serve as a seat for the second end portion of the coil spring 44.

In this manner, it can be additionally appreciated that the entire fastener follower claw assembly, comprising, for example, the fastener follower claw member 24, having the three nail-type fastener engaging fingers 26, 28, 30 disposed thereon, as well as the fastener-follower claw latch-hook member 42, is pivotally mounted in a spring-biased manner upon the nail-type fastener follower mechanism or assembly 10, and in particular, upon the fastener follower body section 12 thereof. Accordingly, such spring-biased mounting of the entire fastener follower claw assembly, and in particular the fastener follower claw member 24 having the three nail-type fastener engaging fingers 26, 28, 30 disposed thereon, permits the fastener follower claw member 24 to effectively ratchet or skip over a new supply of nail-type fasteners, and thereby bypass the new supply of nail-type fasteners, which have been inserted into the magazine section 18 of the fastener-driving tool 20, when the nail-type fastener-follower mechanism or assembly 10 is moved rearwardly, by means of the operator, within or with respect to the magazine section 18 of the fastener driving tool 20. Subsequently, when the fastener follower claw member 24 clears or moves beyond or behind the new supply of nail-type fasteners disposed within the magazine section 18 of the fastener-driving tool 20, the coil spring 44 will effectively restore the fastener follower claw member 24 to its normal position within the magazine section 18 of the fastener-driving tool 20 at which the fingers 26, 28, 30 of the fastener follower claw member 24 can engage the last or trailing one of the supply of nail-type fasteners disposed within the magazine section 18 of the fastener-driving tool 20. It is lastly noted that the magazine section 18 of the fastener-driving tool 20 has an end cap structure 48 fixedly mounted upon the upstream, trailing, or fastener-feeding or insertion end of the magazine section 18 of the fastener-driving tool 20, as can be seen within any one of the FIGS. 2-8, and that the end cap structure 48 is provided with a notched or undercut recessed portion 50 within which an upstanding, transversely oriented wall member 52 is disposed, as can best be seen in FIG. 8, for engagement by means of the fastener-follower claw latch-hook member 42.

Having disclosed the various structural components comprising the nail-type fastener follower mechanism or assembly 10 of the present invention, a brief description of the operation of the same will now be described. More particularly, when it is necessary or desirable to move the nail-type fastener follower mechanism or assembly 10 to its rearwardmost position within the fastener-driving tool 20, and to effectively retain the nail-type fastener follower mechanism or assembly 10 at such rearwardmost position within the fastener-driving tool 20, such as, for example, when it is desired to perform a dry-cycle firing of the tool, that is, to effectively operate the fastener-driving tool 20 without any fasteners present within the magazine section 18 of the fastener-driving tool 20, or alternatively, when it is necessary to rectify a fastener-jammed condition within the fastener-driving tool 20, the new and improved fastener-follower mechanism or assembly 10 of the present invention is operated or actuated in the manner substantially sequentially illustrated within FIGS. 2-8. More specifically, while the new and improved fastener-follower mechanism or assembly 10 of the present invention is disclosed, for example, at an intermediate position within the magazine section 18 of the fastener-driving tool 20, as illustrated within FIG. 2, at which position let it be assumed that a fastener-jammed condition may have occurred, alternatively, for the purposes of the present discussion, the fastener-follower mechanism or assembly 10 could likewise be disposed at substantially its forwardmost position within the magazine section 18 of the fastener-driving tool 20, at which position the operator may want to, for example, initiate a dry-cycle firing of the fastener-driving tool 20.

In either case, that is, in the instance that a fastener-jammed condition has occurred, or in the instance that a dry-cycle firing of the fastener-driving tool 20 is to be initiated, it will be necessary or desirable to move the fastener-follower mechanism or assembly 10 to its rearwardmost position within the magazine section 18 of the fastener-driving tool 20 and to retain the fastener-follower mechanism or assembly 10 at such rearwardmost position within the magazine section 18 of the fastener-driving tool 20. The reason for this is that, in the instance that a fastener-jammed condition has occurred, the rearwardmost disposition of the fastener-follower mechanism or assembly 10 within the magazine section 18 of the fastener-driving tool 20 will facilitate the operator to resolve the jammed condition within the magazine section 18 of the fastener-driving tool 20, whereas in the instance that a dry-cycle firing of the fastener-driving tool 20 is to be initiated, the fastener-follower mechanism or assembly 10 must be moved to, for example, the rearward-most position within the magazine section 18 of the fastener-driving tool 20 in order to thwart or operationally overcome the internal lockout mechanism of the fastener-driving tool 20 which normally prevents the firing of the fastener-driving tool 20 when only a minimum number of fasteners remain within the magazine section 18 of the fastener-driving tool 20, or alternatively, when the supply of fasteners has in fact been entirely depleted or removed from the magazine section 18 of the fastener-driving tool 20.

Figure 3:
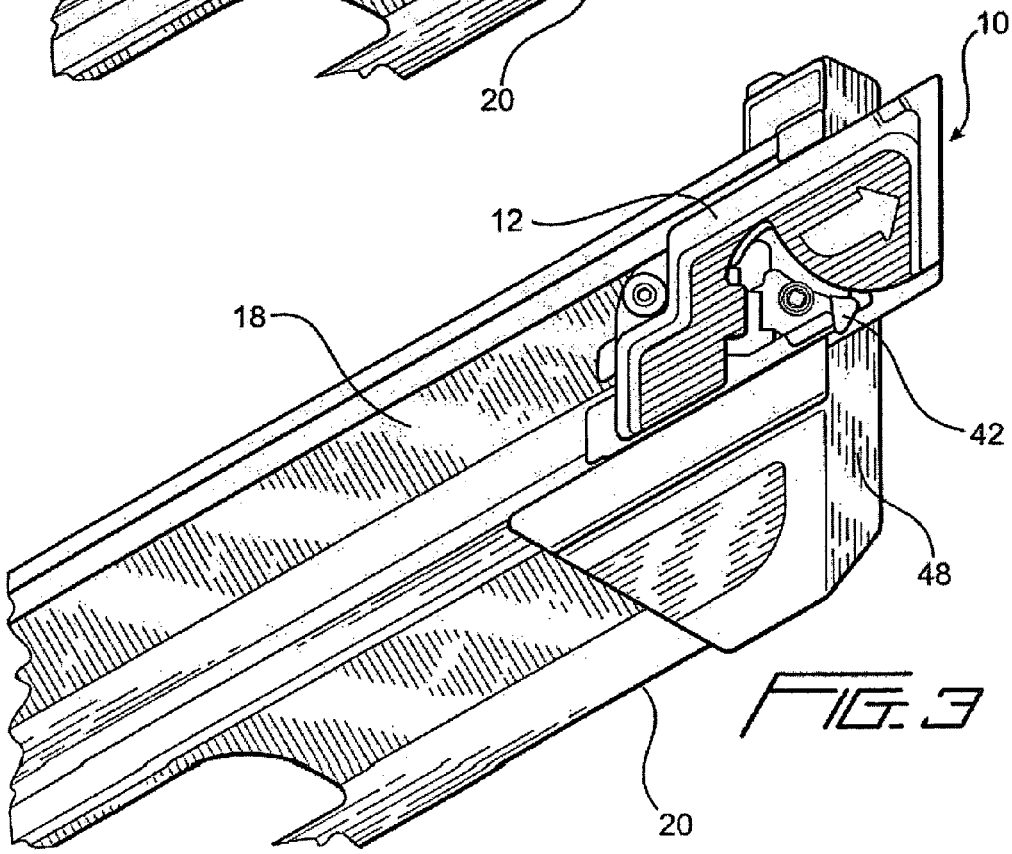
FIG. 3 is a schematic, side elevational view of the fastener-driving tool magazine assembly illustrating the follower mechanism or assembly disposed at its rearwardmost position within and with respect to the fastener-driving tool magazine assembly in preparation for the latching of the same by means of the follower claw latch-hook which is adapted to engage the undercut or recessed portion of the fastener-driving tool magazine end cap.

Accordingly, beginning, for example, with the fastener-follower mechanism or assembly 10 disposed at the position within the magazine section 18 of the fastener-driving tool 20 as illustrated within FIG. 2, the operator will grasp the fastener-follower mechanism or assembly 10 by means of its handle member or portion 22 and move the fastener-follower mechanism or assembly 10 in the rearward direction from the position illustrated within FIG. 2 to its rearwardmost position as illustrated within FIG. 3. At this point in time, as is also illustrated within FIG. 4, the fastener follower claw member 24 is disposed at its normal, pivoted position within the magazine section 18 of the fastener-driving tool 20, as determined by means of its biasing spring 44, whereby the latch-hook member 42 of the fastener-follower claw member 24 is located remote from, and is not disposed within, the notched or undercut recessed portion 50 of the magazine end cap 48 so as not to be engaged with the upstanding, transversely oriented wall member 52 thereof. Subsequently, the latch-hook member 42 of the fastener-follower claw member 24 is depressed inwardly against the spring bias of the coil spring 44 so that the latch-hook member 42 of the fastener-follower claw member 24 is now substantially aligned with the notched or undercut recessed portion 50 of the magazine end cap 48, as illustrated within FIG. 5, and subsequently, still further, as illustrated within FIGS. 6-8, the fastener-follower mechanism or assembly 10 is released whereby the fastener-follower mechanism or assembly 10 will move slightly in the forward direction, under the biasing influence of its biasing spring, whereupon the latch-hook member 42 of the fastener-follower claw member 24 will now be disposed within the notched or undercut recessed portion 50 of the magazine end cap 48 and will engage the upstanding, transversely oriented wall member 52 thereof.

Accordingly, the fastener-follower mechanism or assembly 10 will now be fixedly retained at substantially its rearwardmost position with respect to the magazine section 18 of the fastener-driving tool 20 so as to permit the operator to freely use both hands in connection with the performance of a dry-cycle firing operation of the fastener-driving tool 20, or to rectify a fastener jammed condition within the fastener driving tool 20. In order to release the fastener-follower mechanism or assembly 10 from its engaged and restrained position within the insertion or feed end of the magazine section 18 of the fastener-driving tool 20, as illustrated within FIGS. 6-8, in order to effectively return the fastener-follower mechanism or assembly 10 to its normal fastener follower function within the magazine section 18 of the fastener driving tool 20, reverse procedural steps need only be performed.

Figure 7:
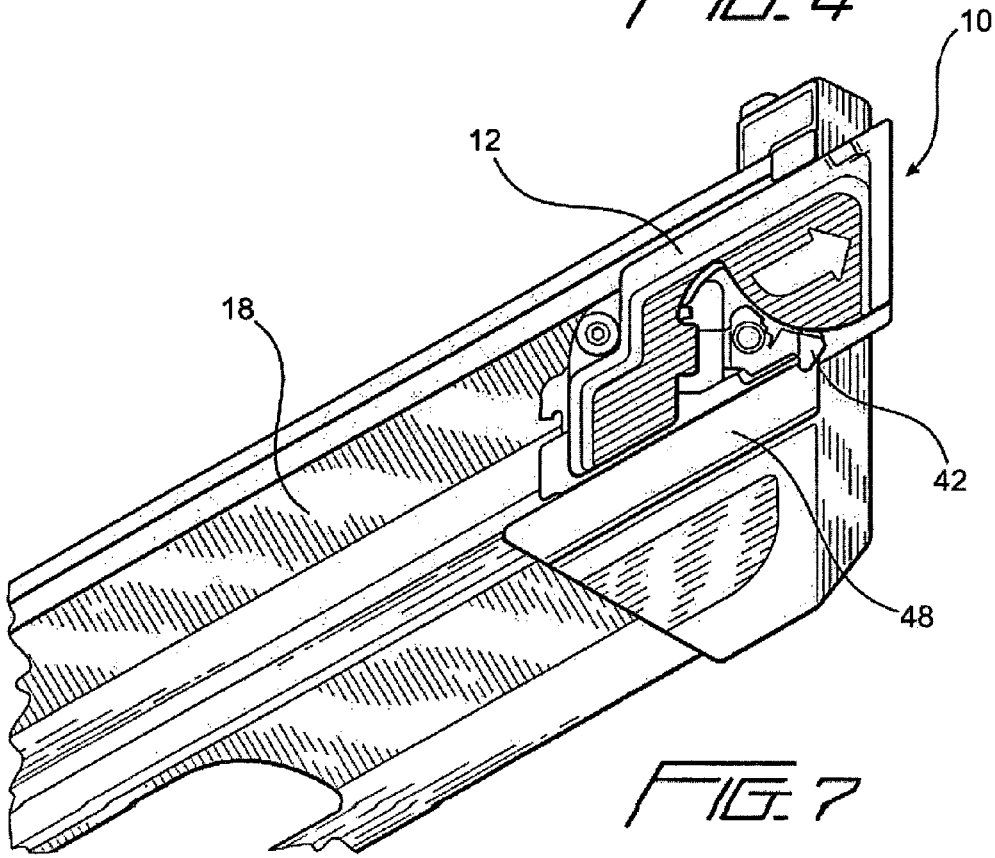
FIG. 7 is a schematic, side elevational view similar to that of FIG. 3, and corresponding to that of FIG. 6 in that the follower claw latch-hook is in fact engaged with the undercut or recessed portion of the fastener-driving tool magazine end cap so as to fixedly retain the follower mechanism or assembly at its latched position with respect to the fastener-driving tool magazine assembly.
Figure 5:
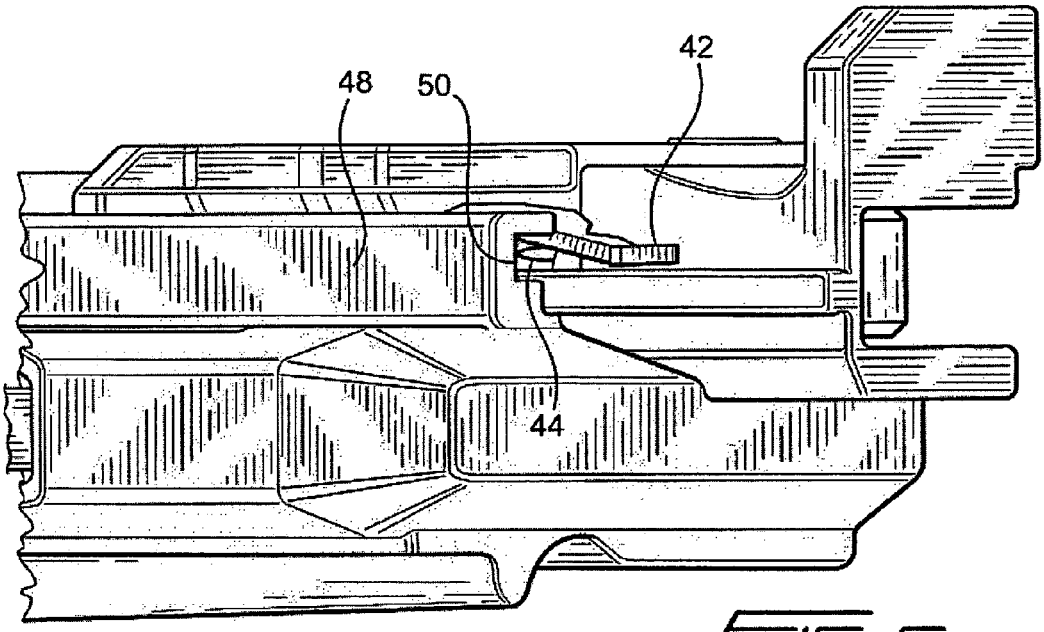
FIG. 5 is a schematic, bottom plan view corresponding to that of FIG. 4 and therefore similarly illustrating the follower mechanism or assembly disposed at its rearwardmost position within and with respect to the fastener-driving tool magazine assembly, but showing, however, the inward depression of the follower claw latch-hook, from its outward misaligned position with respect to the undercut or recessed portion of the fastener-driving tool magazine end cap, to its inward aligned position with respect to the undercut or recessed portion of the fastener-driving tool magazine end cap in preparation for the latching of the same by means of the follower claw latch-hook which will engage the undercut or recessed portion of the fastener-driving tool magazine end cap when the follower mechanism or assembly is released for forward movement under the influence of its biasing spring.
Figure 6:
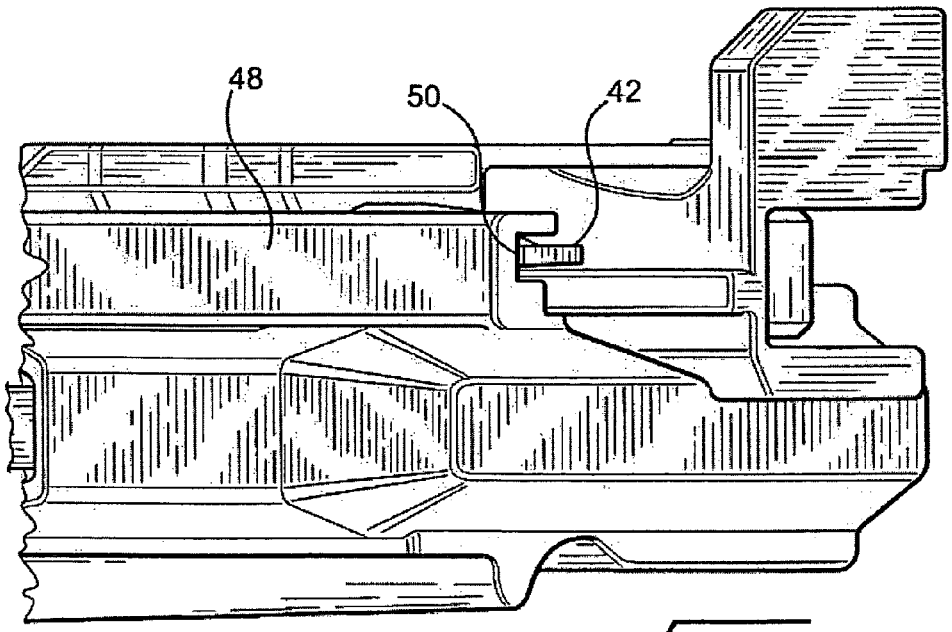
FIG. 6 is a schematic, bottom plan view substantially corresponding to that of FIG. 5 wherein, however, the follower mechanism or assembly has now been released and permitted to move slightly forwardly so as to, in turn, permit the follower claw latch-hook to in fact engage the undercut or recessed portion of the fastener-driving tool magazine end cap so as to fixedly retain the follower mechanism or assembly at its latched position with respect to the fastener-driving tool magazine assembly.
Figure 8:
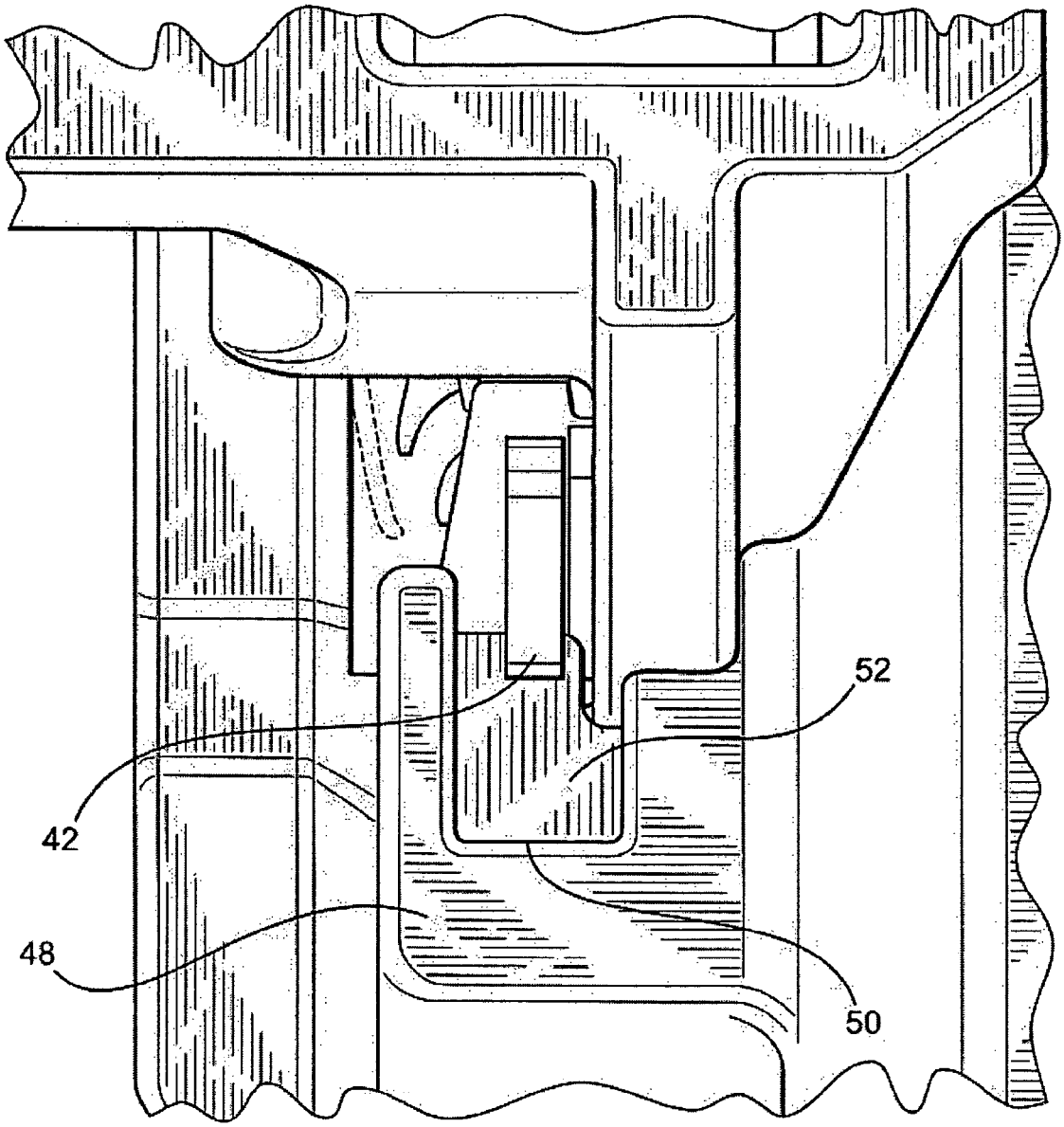
FIG. 8 is an enlarged detail view of the fastener-driving tool magazine assembly as disclosed within FIG. 6 and showing the details of the encircled area of FIG. 6.

More particularly, commencing with the engaged and latched position of the fastener-follower mechanism or assembly 10 with the upstanding, transversely oriented wall member 52 of the end cap portion 48 of the magazine section 18 of the fastener-driving tool 20, as illustrated within FIGS. 6-8, the operator will again grasp the handle member or portion 22 of the fastener-follower mechanism or assembly 10 so as to effectively disengage the latch-hook member 42 of the fastener-follower claw member 24 from the upstanding, transversely oriented wall member 52 of the end cap portion 48 of the magazine section 18 of the fastener-driving tool 20, and subsequently release the fastener-follower mechanism or assembly 10 so as to permit the biasing spring thereof to move the fastener-follower mechanism or assembly 10 in the forward direction within the magazine section 18 of the fastener-driving tool 20. Since the latch-hook member 42 of the fastener-follower claw member 24 has been released from the upstanding, transversely oriented wall member 52 of the end cap portion 48 of the magazine section 18 of the fastener-driving tool 20, the biasing spring 44 will cause the fastener-follower claw member 24 to return to, and regain, its normal position within the magazine section 18 of the fastener-driving tool 20 so as to be prepared to again properly engage the trailing end portion of a supply of nail-type fasteners disposed within the magazine section 18 of the fastener-driving tool 20.

Thus, it may be seen that in accordance with the principles and teachings of the present invention, there has been provided a new and improved fastener-follower mechanism or assembly wherein the follower mechanism or assembly comprises a follower body which is normally spring-biased in the forward direction so as to, in turn, normally bias a strip supply of nail-type fasteners in the forward direction toward a discharge path along which the leading one of the nail-type fasteners will be driven and discharged out from the fastener-driving tool, and wherein a follower claw is normally spring-biased, around the pivotal axis of a pivot pin mounted upon the follower body, to a position at which the follower claw can engage the trailing one of the nailtype fasteners so as to bias the supply strip of nail-type fasteners in the forward direction. A latch-hook is integrally provided upon the follower claw for engaging an undercut region of the fastener-driving tool magazine assembly end cap in order to retain the entire follower mechanism or assembly at a rearwardly retracted position within, or with respect to, the magazine assembly of the fastener-driving machine. In this manner, both of the operator's hands are free so as to facilitate the performance of dry-cycle tool firing operations, or the removal of jammed fasteners from the fastener-driving tool magazine.

Obviously, many variations and modifications of the present invention are possible in light of the above teachings. It is therefore to be understood that within the scope of the appended claims, the present invention may be practiced otherwise than as specifically described herein.

What is claimed is:

1. A fastener-driving tool, comprising:

a fastener magazine within which a supply of fasteners are adapted to be disposed;

an end cap provided upon a rearward section of said fastener magazine;

a notched portion defined upon said end cap of said fastener magazine;

a wall member disposed within said notched portion of said end cap of said fastener magazine; and a follower mechanism, of the bypass type, adapted to be disposed within said fastener magazine of said fastener-driving tool for biasing the supply of fasteners toward a forward position at which leading ones of the supply of fasteners can be serially discharged from said fastener-driving tool, said follower mechanism comprising a follower body adapted to be movably disposed within said magazine of said fastener-driving tool within which the supply of fasteners, to be serially discharged from the fastener-driving tool, are to be disposed; a follower claw for engaging at least the trailing fastener of the supply of fasteners disposed within said fastener magazine of said fastener-driving tool so as to bias the supply of fasteners disposed within said magazine of said fastener-driving tool toward the forward position at which leading ones of the supply of fasteners can be serially discharged from the fastener-driving tool; said follower claw being pivotally mounted upon said follower body between a first position at which said follower claw normally engages the at least trailing fastener of the supply of fasteners disposed within said magazine of said fastener driving tool, and a second position at which said follower claw can bypass the supply of fasteners disposed within said magazine of said fastener driving tool; and a latch hook mounted upon said follower claw for engaging said wall member disposed within said notched portion of said end cap of said fastener magazine so as to retain said follower mechanism at a latched position defined within said rearward section of said fastener magazine.

2. The fastener-driving tool as set forth in claim 1, wherein:

said follower claw comprises a plurality of fingers for engaging at least the trailing fastener of the supply of fasteners disposed within said magazine of said fastener-driving tool.

3. The fastener-driving tool as set forth in claim 2, wherein:

said plurality of fingers disposed upon said follower claw comprises three fingers wherein first and second upper and lower fingers are disposed within a first plane which is disposed at a first divergent angle with respect to a second plane within which said follower claw is disposed, while a third, centrally located one of said three fingers is disposed within a third plane which is disposed at a second oppositely divergent angle with respect to said second plane of said follower claw, said first and third planes thereby forming a substantially V-shaped channel within which at least the trailing fastener of the supply of fasteners disposed within said magazine of said fastener-driving tool can be disposed.

4. The fastener-driving tool as set forth in claim 1, wherein said follower claw is pivotally mounted upon said follower body by:

a pivot pin having opposite end portions thereof fixedly mounted within said follower body;

a clevis member integrally formed upon said follower claw and having opposite end portions thereof pivotally mounted upon said pivot pin; and a spring member interposed between said latch hook of said follower claw and said follower body for biasing said follower claw toward said first position.

5. The fastener-driving tool as set forth in claim 4, further comprising:

a first stub shaft fixedly mounted upon an interior surface of said latch hook for defining a first seat member for a first end portion of said spring member; and a second stub shaft fixedly mounted upon an interior surface of said follower body for defining a second seat member for a second end portion of said spring member.

6. The fastener-driving tool as set forth in claim 4, further comprising:

a cross-piece member extending transversely through said follower body, wherein said follower claw is integrally mounted upon a first end portion of said cross-piece member, said latch hook is integrally mounted upon a second end portion of said cross-piece member, and said clevis member is integrally mounted upon an intermediate portion of said cross-piece member.

7. A fastener-driving tool, comprising:

a fastener magazine within which a supply of fasteners are adapted to be disposed; and a follower mechanism, of the bypass type, adapted to be disposed within said fastener magazine of said fastener-driving tool for biasing the supply of fasteners toward a forward position at which leading ones of the supply of fasteners can be serially discharged from said fastener-driving tool, said follower mechanism comprising a follower body adapted to be movably disposed within said magazine of said fastener-driving tool within which a supply of fasteners, to be serially discharged from the fastener-driving tool, are to be disposed; and a follower claw for engaging at least the trailing fastener of the supply of fasteners disposed within said magazine of said fastener-driving tool so as to bias the supply of fasteners disposed within said magazine of said fastener-driving tool toward the forward position at which leading ones of the supply of fasteners can be serially discharged from said fastener-driving tool, wherein said follower claw comprises a plurality of fingers for engaging at least the trailing fastener of the supply of fasteners disposed within said magazine of said fastener-driving tool.

8. The fastener-driving tool as set forth in claim 7, wherein:

said fastener magazine comprises an end cap member disposed upon a rearward section of said fastener magazine;

said follower claw includes a latch hook; and said rearward section of said fastener magazine, upon which said end cap member is disposed, comprises a notched portion for engaging said latch hook of said follower claw so as to retain said follower mechanism at a latched position defined within said rearward section of said fastener magazine.

9. The fastener-driving tool as set forth in claim 8, further comprising:

a transversely oriented wall member disposed within said notched portion of said fastener magazine end cap member for engaging said latch hook of said follower claw.

10. The fastener-driving tool as set forth in claim 7, wherein said follower claw is pivotally mounted upon said follower body by:

a pivot pin having opposite end portions thereof fixedly mounted within said follower body;

a clevis member integrally formed upon said follower claw and having opposite end portions thereof pivotally mounted upon said pivot pin; and a spring member interposed between said latch hook means of said follower claw and said follower body for biasing said follower claw toward said first position.

11. The fastener-driving tool as set forth in claim 10, further comprising:

a first stub shaft fixedly mounted upon an interior surface of said latch hook for defining a first seat member for a first end portion of said spring member; and a second stub shaft fixedly mounted upon an interior surface of said follower body for defining a second seat member for a second end portion of said spring member.

12. The fastener-driving tool as set forth in claim 10, further comprising:

a cross-piece member extending transversely through said follower body, wherein said follower claw is integrally mounted upon a first end portion of said cross-piece member, said latch hook is integrally mounted upon a second end portion of said cross-piece member, and said clevis member is integrally mounted upon an intermediate portion of said cross-piece member.

13. The fastener-driving tool as set forth in claim 7, wherein:

said plurality of fingers disposed upon said follower claw comprises three fingers wherein first and second upper and lower fingers are disposed within a first plane which is disposed at a first divergent angle with respect to a second plane within which said follower claw is disposed, while a third, centrally located one of said three fingers is disposed within a third plane which is disposed at a second oppositely divergent angle with respect to said second plane of said follower claw, said first and third planes thereby forming a substantially V-shaped channel within which at least the trailing fastener of the supply of fasteners disposed within said magazine of said fastener-driving tool can be disposed.

14. A fastener-driving tool, comprising:

a fastener magazine within which a supply of fasteners are adapted to be disposed; and a follower mechanism, of the bypass type, adapted to be disposed within said fastener magazine of said fastener-driving tool for biasing the supply of fasteners toward a forward position at which leading ones of the supply of fasteners can be serially discharged from said fastener-driving tool, said follower mechanism comprising a follower body adapted to be movably disposed within said magazine of said fastener-driving tool within which a supply of fasteners, to be serially discharged from the fastener-driving tool, are to be disposed; a follower claw for engaging at least the trailing fastener of the supply of fasteners disposed within said magazine of said fastener-driving tool so as to bias the supply of fasteners disposed within said magazine of said fastener-driving tool toward the forward position at which leading ones of the supply of fasteners can be serially discharged from said fastener-driving tool, and a latch hook for retaining said follower mechanism at a rearward position within said magazine of said fastener-driving tool, said follower claw being pivotally mounted upon said follower body by a pivot pin having opposite end portions thereof fixedly mounted within said follower body; a clevis member integrally formed upon said follower claw and having opposite end portions thereof pivotally mounted upon said pivot pin; and a cross-piece member extending transversely through said follower body, wherein said follower claw is integrally mounted upon a first end portion of said cross-piece member, said latch hook is integrally mounted upon a second end portion of said cross-piece member, and said clevis member is integrally mounted upon an intermediate portion of said cross-piece member.

15. The fastener-driving tool as set forth in claim 14, wherein:

said follower claw comprises a plurality of fingers for engaging at least the trailing fastener of the supply of fasteners disposed within said magazine of said fastener-driving tool.

16. The fastener-driving tool as set forth in claim 15, wherein:

said plurality of fingers disposed upon said follower claw comprises three fingers wherein first and second upper and lower fingers are disposed within a first plane which is disposed at a first divergent angle with respect to a second plane within which said follower claw is disposed, while a third, centrally located one of said three fingers is disposed within a third plane which is disposed at an oppositely divergent angle with respect to said second plane of said follower claw, said first and third planes forming a substantially V-shaped channel within which at least the trailing fastener of the supply of fasteners disposed within said magazine of said fastener-driving tool can be disposed.

17. The fastener-driving tool as set forth in claim 14, wherein:

said fastener magazine comprises an end cap member disposed upon a rearward section of said fastener magazine;

said follower claw includes a latch hook; and said rearward section of said fastener magazine, upon which said end cap member is disposed, comprises a notched portion for engaging said latch hook of said follower claw so as to retain said follower mechanism at a latched position defined within said rearward section of said fastener magazine.

18. The fastener-driving tool as set forth in claim 17, further comprising:

a transversely oriented wall member disposed within said notched portion of said fastener magazine end cap member for engaging said latch hook of said follower claw.

19. The fastener-driving tool as set forth in claim 14, further comprising:

a spring member interposed between said latch hook of said follower claw and said follower body for biasing said follower claw toward a position at which said follower claw normally engages the at least trailing fastener of the supply of fasteners disposed within said magazine of said fastener driving tool.

20. The fastener-driving tool as set forth in claim 19, further comprising:

a first stub shaft fixedly mounted upon an interior surface of said latch hook for defining a first seat member for a first end portion of said spring member; and a second stub shaft fixedly mounted upon an interior surface of said follower body for defining a second seat member for a second end portion of said spring member.

* * * * *